United States Patent [19]

Borror et al.

[11] 4,293,433

[45] Oct. 6, 1981

[54] PERCHLOROETHYLENE DIELECTRIC FLUID CONTAINING PYRROLE AND PHENOL

[75] Inventors: Jack A. Borror, Chesterland; Edward A. Rowe, Jr., North Perry, both of Ohio

[73] Assignee: Diamond Shamrock Corporation, Dallas, Tex.

[21] Appl. No.: 155,070

[22] Filed: Jun. 2, 1980

[51] Int. Cl.[3] ..... H01B 3/18; H01B 3/24

[52] U.S. Cl. ..... 336/94; 252/575; 361/327; 174/17 LF; 570/109

[58] Field of Search ..... 252/63.7, 66; 260/652.5 R

[56] References Cited

U.S. PATENT DOCUMENTS

| | | | |
|---|---|---|---|
| 1,966,901 | 7/1934 | McMahon | 174/17 LF X |
| 2,019,338 | 10/1935 | Clark | 252/66 |
| 2,155,723 | 4/1939 | Levine et al. | 260/652.5 R |
| 2,492,048 | 12/1949 | Klabunde | 260/652.5 R |
| 2,911,449 | 11/1959 | Herman et al. | 260/652.5 |
| 2,917,555 | 12/1959 | McDonald et al. | 260/652.5 |
| 2,958,712 | 11/1960 | Starks | 260/652.5 |
| 3,040,108 | 6/1962 | Campbell | 260/652.5 |
| 3,424,805 | 1/1969 | Fruhwirth et al. | 260/652.5 |
| 3,551,505 | 12/1970 | Ryckaert et al. | 260/652.5 |
| 3,976,605 | 8/1976 | Matsunaga et al. | 260/31.4 R X |
| 4,034,051 | 7/1977 | Dempf et al. | 260/652.5 R |

FOREIGN PATENT DOCUMENTS

| | | | |
|---|---|---|---|
| 764457 | 9/1971 | Belgium | 260/652.5 R |
| 2317258 | 2/1977 | France . | |
| 765522 | 1/1957 | United Kingdom | 260/652.5 R |

*Primary Examiner*—Mayer Weinblatt
*Attorney, Agent, or Firm*—William A. Skinner

[57] ABSTRACT

Electrical devices such as transformers and power capacitors are improved by the use of a dielectric fluid prepared by combining perchloroethylene having a low chlorinated ethane content with an antioxidant. This fluid has excellent resistance to decomposition over long periods of time and under severe operational conditions.

14 Claims, No Drawings

PERCHLOROETHYLENE DIELECTRIC FLUID CONTAINING PYRROLE AND PHENOL

BACKGROUND OF THE INVENTION

This invention relates generally to electrical devices containing dielectric fluids, and more particularly to stable halogenated dielectric fluids.

Electrical devices such as power capacitors, transformers, condensers, cables, circuit breakers and the like often utilize a dielectric fluid as an insulating and cooling medium. For their insulating function, dielectric fluids must have high electrical resistance, high dielectric strength, and low conductivity. In the cooling function, the fluids should have characteristics such as good heat transfer and dissipation, low freezing point and high boiling point. A satisfactory dielectric fluid will also be nonflammable. Most importantly, the fluid must have excellent resistance to decomposition over long periods of time and under severe operational conditions. The dielectric fluid must not decompose to form electrically conductive or corrosive materials.

Many materials have previously been employed as dielectric fluids, including mineral oils, esters of organic acids, castor oil, aromatic hydrocarbons and alkylates thereof, and the like. Few of these materials display all of the requisite characteristics for a satisfactory dielectric. The halogenated hydrocarbons such as trichloroethylene and perchloroethylene have also been suggested as dielectric fluids, particularly in combination with other chlorinated ethylenes and chlorinated aromatic hydrocarbons. Such combinations are disclosed in U.S. Pat. No. 1,966,901 and U.S. Pat. No. 2,019,338. Unfortunately these compositions do not display good resistance to decomposition over long periods.

More recently, the highly chlorinated hydrocarbons such as polychlorinated biphenyls have been widely used. While these materials are functionally advantageous, they are objectionable because of their toxicity and persistence in the environment. Therefore, dielectric fluids which are nontoxic, nonflammable, environmentally acceptable, economical and resistant to degradation have been actively sought.

SUMMARY OF THE INVENTION

It has been discovered that electrical devices containing a dielectric fluid comprising a stabilized perchloroethylene composition display excellent performance over extended periods of time. The improved dielectric fluid is prepared by combining perchloroethylene which has a low halogenated ethane content with an antioxidant stabilizer. The resulting composition meets all of the requisites for use as a dielectric fluid, including outstanding resistance to decomposition.

DESCRIPTION OF THE INVENTION

When used in electrical devices such as transformers, a dielectric fluid must be able to operate effectively at elevated temperatures of about 80° to 90° C. for approximately 30 years and also be able to withstand short periods of temperatures up to 200° C. Should degradation of the dielectric occur under such conditions, products which are corrosive to the materials of construction of the electrical device and which impair the insulating characteristics of the fluid may be formed. This problem will be further aggravated should oxygen be present. While dielectric fluids are normally intended for use in a relatively oxygen free environment, it is impractical to completely exclude oxygen from most electrical devices. Therefore, a perchloroethylene (tetrachloroethylene) dielectric composition which remains stable at high temperatures in the presence of oxygen is highly desirable.

It has now been discovered that a primary problem in the use of perchloroethylene as a dielectric fluid lies in the presence of chlorinated ethane impurities in typical commercial perchloroethylene. Such chlorinated ethanes include 1,2-dichloroethane, 1,1,1- and 1,1,2-trichloroethane, unsymmetrical and symmetrical tetrachloroethane, pentachloroethane and hexachloroethane. These impurities are often found in crude perchloroethylene at levels up to 0.3 percent by weight. The chlorinated ethanes have been found to undergo dehydrochlorination when exposed to the conditions encountered in electrical devices. This dehydrochlorination results in the formation of hydrogen chloride, with deleterious effects on the dielectric fluid and the electrical device. Recognition of this problem has led to the discovery that only perchloroethylene containing less than about 0.005 percent by weight of total chlorinated ethanes is satisfactory for use as a dielectric.

While the total amount of chlorinated ethanes present in the perchloroethylene should not exceed 0.005 percent (50 parts per million by weight), it is also preferred that the various species of chloroethanes be limited. For example, best results are obtained when the perchloroethylene dielectric contains less than about 0.001 percent of each of dichloroethane, trichloroethane, symmetrical tetrachloroethane, pentachloroethane and hexachloroethane, and less than about 0.003 percent of unsymmetrical tetrachloroethane in the total. Perchloroethylene having the required purity can be prepared by a number of conventional processes, including that described in U.S. Pat. No. 3,976,705. Crude perchloroethylene may also be purified by known methods such as scrubbing and distillation.

It has further been discovered that the effectiveness of perchloroethylene low in chlorinated ethanes as a dielectric fluid is greatly enhanced by combination with an antioxidant stabilizer. Perchloroethylene and oxygen react to produce tetrachloroethylene oxide, which degrades to organic acids and hydrochloric acid. The combination of perchloroethylene low in chloroethane impurities, which eliminates the dehydrochlorination problem, with an antioxidant stabilizer which inhibits the decomposition of perchloroethylene in the presence of oxygen at elevated temperatures, results in a dielectric fluid with outstanding characteristics for use in electrical devices.

In a preferred embodiment, the perchloroethylene is combined with N-methyl pyrrole and p-tertiary amyl phenol (pentaphen) in amounts which are effective to stabilize the perchloroethylene against decomposition under the conditions existing in electrical devices. While the amount of N-methyl pyrrole and p-tertiary amyl phenol combined with the perchloroethylene may be varied according to the environment of use, the quantities usually range from about 0.0005 to about 0.02 weight percent N-methyl pyrrole and from about 0.0001 to about 0.01 weight percent p-tertiary amyl phenol based on the total weight of dielectric fluid. Preferably, the stabilized perchloroethylene dielectric will contain at least about 0.0025 percent N-methyl pyrrole and at least about 0.0005 percent p-tertiary amyl phenol. Although higher concentrations of these materials will not be harmful, the increased cost is seldom justified.

Minor amounts of other additives may optionally be employed in the dielectric fluid, although they are normally not required. Such additives can include corrosion inhibitors, hydrolytic stabilizers, dyes, pour point regulants, viscosity index improvers, lubricating agents, other dielectric fluids, and the like. The amount of such materials can be any quantity which does not adversely affect the results achieved by the present invention.

It is important that the stabilizer system incorporated into the dielectric be effective in preventing decomposition of the fluid in both the liquid and vapor phases. Many electrical devices requiring a dielectric fluid operate at temperature and pressure conditions which result in the formation of a vapor phase in addition to the liquid phase of the fluid. Since reaction with oxygen occurs even more readily in the vapor phase, the perchloroethylene dielectric must be effectively stabilized in both phases. The preferred synergistic system of N-methyl pyrrole (b.p. 112° C.) and p-tertiary amyl phenol (b.p. 266° C.) has been found to provide outstanding stabilization in both the liquid and vapor phases of perchloroethylene (b.p. 121° C.).

The invention is further illustrated by the following examples.

EXAMPLE 1

A test was devised to simulate the operating environment of an electrical transformer over an approximate 30-year period by heating the dielectric fluid in a sealed cylinder at about 175° C. for a period of 5 to 20 days. The 20-day treatment was calculated to be approximately equivalent to 30 years in a transformer application.

A stock solution was prepared by washing perchloroethylene with an equal volume of 2 percent $NH_4OH$ solution at 82° C. for one hour to remove acid and acid forming contaminants. The aqueous phase was siphoned off and the washing was repeated using deionized water. The water was decanted and 5 ppm p-tertiary amyl phenol was added to stabilize the perchloroethylene during further handling. This perchloroethylene contained about 0.002 percent unsymmetrical tetrachloroethane, less than 0.0005 percent 1,1,2-trichloroethane, and less than 0.0002 percent of each of the other chlorinated ethanes. The perchloroethylene was transferred to amber collection bottles and simultaneously nitrogen was bubbled through until a pH of 7.0 was reached, indicating that all excess $NH_3$ had been removed. The desired amounts of N-methyl pyrrole and p-tertiary amyl phenol were then added, the bottles were sealed, and the headspace was nitrogen padded to exclude oxygen.

In the test procedure, 150 ml stainless steel cylinders fitted with bellows valves were rinsed with a 0.1 percent chromic acid solution and then baked overnight at 90° C. in a forced air oven. After cooling, the cylinders were filled by first evacuating, then aspirating in 150 ml of stock perchloroethylene, evacuating, then aspirating in 100 ml of the sample for testing from a graduated cylinder under nitrogen. The full cylinder was pressurized with 40 psig nitrogen and vented after one minute. This procedure was repeated three times to purge any traces of air that may have entered the cylinder during loading. At this point, any air necessary for the test was introduced by syringe through a septum over the bellows valve inlet to achieve the desired air content in the headspace. The cylinders were then placed in a forced air oven at 175° C. for the desired length of time.

After the test period, the perchloroethylene was analyzed to determine acidity (calculated as parts per million HCl by weight) and pH. Results are set forth in Table I. It can be seen that the combination of N-methyl pyrrole and p-tertiary amyl phenol with perchloroethylene provides a dielectric fluid which is stable at high temperatures even in the presence of extremes of 25 to 50 percent air.

TABLE 1

| Stabilizer (p.p.m.) | | | | | |
|---|---|---|---|---|---|
| N-methyl pyrrole | p-tertiary amyl phenol | Air (volume %) | pH | Acidity (p.p.m. HCl) | Duration (days) |
| 25 | 5 | 0.5 | 6.9 | 0.5 | 5 |
| 25 | 5 | 5.0 | 6.9 | 0.5 | 5 |
| 25 | 5 | 10 | 6.2 | 4.5 | 5 |
| 25 | 5 | 25 | 6.4 | 3.0 | 5 |
| 25 | 5 | 50 | 6.4 | 4.8 | 5 |
| 25 | 5 | 100 | <3 | 204 | 5 |
| 25 | 25 | 0.5 | 6.9 | 1.0 | 5 |
| 25 | 25 | 1.0 | 6.9 | 0.5 | 5 |
| 25 | 25 | 3.0 | 6.9 | 0.5 | 5 |
| 50 | 5 | 0.5 | 6.9 | 0.5 | 5 |
| 50 | 5 | 1.0 | 6.9 | 0.5 | 5 |
| 50 | 5 | 3.0 | 6.9 | 0.5 | 5 |
| 50 | 5 | 5.0 | 6.9 | 0.5 | 5 |
| 50 | 5 | 10 | 6.8 | 0.9 | 5 |
| 50 | 5 | 10 | 6.4 | 5.5 | 10 |
| 50 | 5 | 10 | 6.8 | 0.5 | 20 |
| 50 | 5 | 25 | 6.8 | 0.9 | 5 |
| 50 | 5 | 50 | 6.6 | 1.3 | 5 |
| 50 | 5 | 100 | <3 | 96 | 5 |
| 50 | 25 | 10 | 6.8 | 0.8 | 5 |
| 50 | 25 | 25 | 6.6 | 3.2 | 5 |
| 50 | 25 | 50 | 5.4 | 12.5 | 5 |
| 50 | 25 | 100 | <3 | 121 | 5 |
| 100 | 5 | 10 | 6.8 | 0.9 | 5 |
| 100 | 5 | 25 | 6.4 | 4.4 | 5 |
| 100 | 5 | 50 | 6.0 | 7.1 | 5 |
| 100 | 5 | 100 | <3 | 149 | 5 |

EXAMPLE 2

The preferred dielectric fluid of the invention was compared to perchloroethylene containing a number of commonly used stabilizers for chlorinated hydrocarbons. The test procedure described in Example 1 was used, with 10 percent air in the headspace and a test period of 5 days (at 175° C.). The tolerance of the stabilized perchloroethylene compositions to air at high temperature was again measured by determining acidity formation and pH. The results are set forth in Table II.

TABLE II

| Stabilizer | Stabilizer Level ppm by Wt. | Acidity ppm by Wt. | pH |
|---|---|---|---|
| N-methyl pyrrole/pentaphen | 50/5 | 0.5 | 6.9 |
| Thymol | 50 | 95.0 | 3.0 |
| Propylene glycol monomethyl ether | 2,500 | 8.0 | 6.2 |
| Allyl glycidal ether | 500 | 73.0 | 3.0 |
| Dioxane | 10,000 | 16.0 | 5.2 |
| Butyl acetate | 2,500 | 111.0 | 3.0 |
| Epichlorohydrin | 1,500 | 79.0 | 3.0 |
| Epibromohydrin | 800 | 197.0 | 3.0 |
| 1,2 Butylene oxide | 1,200 | 111.0 | 3.0 |
| Diisopropylamine | 50 | 56.0 | 3.0 |
| Diethylamine | 50 | 40.0 | 3.0 |
| Pyridine | 50 | 17.0 | 5.2 |
| Butylated hydroxytoluene | 50 | 87.0 | 3.0 |
| Hydroquinone | 50 | 26.0 | 3.0 |
| Acrylonitrile | 2,500 | 105.0 | 3.0 |

TABLE II-continued

| Stabilizer | Stabilizer Level ppm by Wt. | Acidity ppm by Wt. | pH |
|---|---|---|---|
| Methacrylonitrile | 2,500 | 690.0 | 3.0 |
| Diisobutylene | 2,500 | 40.0 | 3.0 |
| Amylene | 250 | 134.0 | 3.0 |
| Glycidol | 500 | 71.0 | 3.0 |
| N-methyl morpholine | 50 | 16.0 | 5.4 |
| Quinoline | 50 | 8.0 | 6.0 |
| Cyclohexane | 120 | 205.0 | 3.0 |
| Pentaphen (½% Air) | 25 | 8.0 | 6.0 |
| Pentaphen (1% Air) | 25 | 11.0 | 5.4 |

From the results set forth in the tables, it is clear that the combination of N-methyl pyrrole and p-tertiary amyl phenol with perchloroethylene containing less than 0.005 percent chlorinated ethanes results in a dielectric fluid having excellent resistance to decomposition even at elevated temperatures in the presence of oxygen. Such resistance would not be expected based on the poor performance of commonly used stabilizers under similar conditions.

The electrical devices which can be improved by use of the disclosed dielectric fluid are well known. Such devices are designed to be insulated with a liquid, and are illustrated by power capacitors and transformers.

What is claimed is:

1. In an electrical device containing a dielectric fluid, the improvement which comprises employing as the dielectric fluid a perchloroethylene composition which is resistant to decomposition at elevated temperatures in the presence of oxygen, containing less than about 0.005 percent of chlorinated ethanes, and a synergistic mixture of N-methyl pyrrole and p-tertiary amyl phenol.

2. The device of claim 1 wherein the perchloroethylene contains from about 0.0005 to about 0.02 percent N-methyl pyrrole and from about 0.0001 to about 0.01 percent p-tertiary amyl phenol.

3. The device of claim 1 wherein the perchloroethylene contains at least about 0.0025 percent N-methyl pyrrole and at least about 0.0005 percent p-tertiary amyl phenol.

4. The device of claim 1 wherein the electrical device is a transformer.

5. A method of preparing an improved dielectric fluid, resistant to decomposition at elevated temperatures in the presence of oxygen, which method comprises combining perchloroethylene which contains less than about 0.005 percent chlorinated ethanes with a synergistic mixture of N-methyl pyrrole and p-tertiary amyl phenol.

6. The method of claim 5 wherein the perchloroethylene is combined with from about 0.0005 to about 0.02 percent N-methyl pyrrole and from about 0.0001 to about 0.01 percent p-tertiary amyl phenol.

7. The method of claim 5 wherein the perchloroethylene is combined with at least about 0.0025 percent N-methyl pyrrole and at least about 0.0005 percent p-tertiary amyl phenol.

8. A dielectric fluid composition which is resistant to decomposition at elevated temperatures in the presence of oxygen, comprising perchlorethylene containing less than about 0.005 percent chlorinated ethanes, and a synergistic mixture of N-methyl pyrrole and p-tertiary amyl phenol.

9. The composition of claim 8 wherein the perchloroethylene contains from about 0.0005 to about 0.02 percent N-methyl pyrrole and from about 0.0001 to about 0.01 percent p-tertiary amyl phenol.

10. The composition of claim 8 wherein the perchloroethylene contains at least about 0.0025 percent N-methyl pyrrole and at least about 0.0005 percent p-tertiary amyl phenol.

11. In a transformer, the improvement which comprises insulation material comprising the dielectric fluid composition of claim 10.

12. An apparatus comprising an electrical device and a dielectric fluid composition, said dielectric fluid comprising perchlorethylene containing less than about 0.005 percent chlorinated ethanes, and a synergistic mixture of N-methyl pyrrole and p-tertiary amyl phenol.

13. An apparatus comprising a container, an electrical device therein, a dielectric fluid composition comprising perchloroethylene surrounding said device, said perchloroethylene being resistant to decomposition at elevated temperature in the presence of oxygen and containing less than about 0.005 percent chlorinated ethanes, and a synergistic mixture of N-methyl pyrrole and p-tertiary amyl phenol.

14. A method of insulating an electrical device which comprises surrounding said device with a fluid composition especially adapted for use as a dielectric, comprising perchloroethylene containing less than about 0.005 percent chlorinated ethanes, and a synergistic mixture of N-methyl pyrrole and p-tertiary amyl phenol.

* * * * *